US005192258A

United States Patent [19]

Keller

[11] Patent Number: 5,192,258

[45] Date of Patent: Mar. 9, 1993

[54] TRAINING DEVICE ESPECIALLY ADAPTED FOR TEACHING SNOW BOARDING TECHNIQUES

[76] Inventor: Martin Keller, 13880 Wide Acres Rd., Golden, Colo. 80401

[21] Appl. No.: 603,651

[22] Filed: Oct. 26, 1990

[51] Int. Cl.[5] ..... A63B 22/00

[52] U.S. Cl. ..... 482/71; 482/51; 434/253

[58] Field of Search ..... 272/97, 96, 93, 94, 272/146; 434/253; 482/114, 115, 118, 66, 70, 71, 51

[56] References Cited

U.S. PATENT DOCUMENTS

| | | | |
|---|---|---|---|
| 3,107,914 | 10/1963 | Swisher . | |
| 3,408,067 | 10/1968 | Armstrong . | |
| 3,511,499 | 5/1970 | Schawalder . | |
| 3,575,412 | 4/1971 | Arsenian . | |
| 3,807,727 | 4/1974 | Ferguson . | |
| 4,183,521 | 1/1980 | Kroeker . | |
| 4,252,312 | 2/1981 | Dehan . | |
| 4,290,601 | 9/1981 | Mittelstadt . | |
| 4,386,915 | 6/1983 | Gilliam . | |
| 4,505,477 | 3/1985 | Wilkinson . | |
| 4,669,723 | 6/1987 | Arsenian | 272/97 |
| 4,708,339 | 11/1974 | Perrine . | |
| 4,787,630 | 11/1988 | Watson . | |
| 4,911,430 | 3/1990 | Flament | 272/97 |

FOREIGN PATENT DOCUMENTS

| | | | |
|---|---|---|---|
| 204939 | 1/1959 | Austria . | |
| 0832295 | 9/1938 | France | 272/97 |
| 832295 | 9/1938 | France . | |
| 0886917 | 12/1981 | U.S.S.R. | 272/97 |

OTHER PUBLICATIONS

Ski Magazine, Skier's Edge Advertisement—Oct., 1990.

*Primary Examiner*—Stephen R. Crow

[57] ABSTRACT

A snow boarding training device includes a frame possessing a horizontal base and two spaced vertical posts. A tubular arcuate track extends between the posts and forms a segment of a circle lying in a plane inclined with respect to a horizontal plane at an angle between about ten and thirty degrees. An elongated support member formed in the shape of a snow board is secured adjacent a first, lower end to the base by a ball and socket mechanism. The support member is mounted for movement along the track by a guide roller assembly disposed on the bottom surface of the support member, adjacent a second opposite, upper end. The guide roller assembly includes two brackets mounting two pairs of rollers, with one roller of each pair positioned above the tubular track and having a concave surface conforming to the tubular track. Another roller of each pair is positioned below the tubular track and is adjustably mounted for pivotal movement, with the associated bracket, toward and away from the track, such that separation of the rollers can be adjusted to regulate resistance to movement of the support member along the track. Resilient disks are disposed at opposite ends of the track and form stops which limit the extent of movement of the support member along the track. As the support member moves upwardly from a lowest intermediate position on the track toward either side, a compound arcuate motion will be imparted to the support member, simulating a snow board.

78 Claims, 4 Drawing Sheets

TRAINING DEVICE ESPECIALLY ADAPTED FOR TEACHING SNOW BOARDING TECHNIQUES

BACKGROUND OF THE INVENTION

The present invention relates to training devices, and more particularly pertains to an improved training device for teaching snow boarding techniques. The sport of snow boarding has become increasingly popular, creating demand for instruction in the use of snow boards. Snow boards are essentially flat, elongated boards having a straight back end edge or heel, and a rounded tip. An individual stands with both feet on the top surface of the board, and slides down a snow covered slope, controlling the board by shifting his weight and rotating his lower body, somewhat in the manner of a surfing. Before an individual can completely and consistently control the course of the snow board down the slope, considerable practice is required to develop proper edging, balance and technique. Because of the potential danger to both a novice snow boarder and to other individuals in the vicinity, it is desirable that the novice be afforded a training device for preliminary practice, so as to achieve a measure of control before venturing onto a slope.

Additionally, snow boards utilize a binding system consisting of buckled vamps which are secured to the top of the board and placed over the boots of the user. Typically, an individual places one foot forward of the other on the board, while facing somewhat sideways. Individuals differ in their preferences as to position of foot placement, and some individuals prefer to have their left foot forward, while some prefer to have &heir right foot forward. Also, some individuals prefer to have their forward foot pointed relatively more or less toward the front of the snow board. All of these different factors must be evaluated to properly position the bindings on the snow board. Accordingly, it is desirable to provide a snow board simulating device to assist in the evaluation of these individual factors.

Because snow boarding requires considerable muscular strength, even experienced snow boarders must be in good condition to perform well. Accordingly, it is desirable to provide a training device to allow such individuals to practice away from the snow and in the off season to develop strength, coordination and aerobic conditioning.

SUMMARY OF THE INVENTION

In order to achieve these and other objects of the invention, the present invention provides an improved training device for snow boarding which includes a frame possessing a horizontal base and two spaced vertical posts. A tubular arcuate track extends between the posts and forms a segment of a circle lying in a plane inclined with respect to a horizontal plane at an angle between about ten and thirty degrees. An elongated support member formed in the shape of a snow board is secured adjacent a first, lower end to the base by a ball and socket mechanism. The support member is mounted for movement along the track by a guide roller assembly disposed on the bottom surface of the support member, adjacent a second, opposite, upper end. The guide roller assembly includes two brackets mounting two pairs of rollers, with one roller of each pair positioned above the tubular track and having a concave surface conforming to the tubular track. Another roller of each pair is positioned below the tubular track and is adjustably mounted for pivotal movement, with the associated bracket, toward and away from the track, such that separation of the rollers can be adjusted to regulate resistance to movement of the support member along the track. Resilient disks are disposed at opposite ends of the track and form stops which limit the extent of movement of the support member along the track. As the support member moves upwardly from a lowest intermediate position on the track toward either side, a compound arcuate motion will be imparted to the support member, causing the corresponding side edge of the support member to incline upwardly, simulating the turning technique of an actual snow board.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE PREFERRED EMBODIMENT(S)

Figure 1:
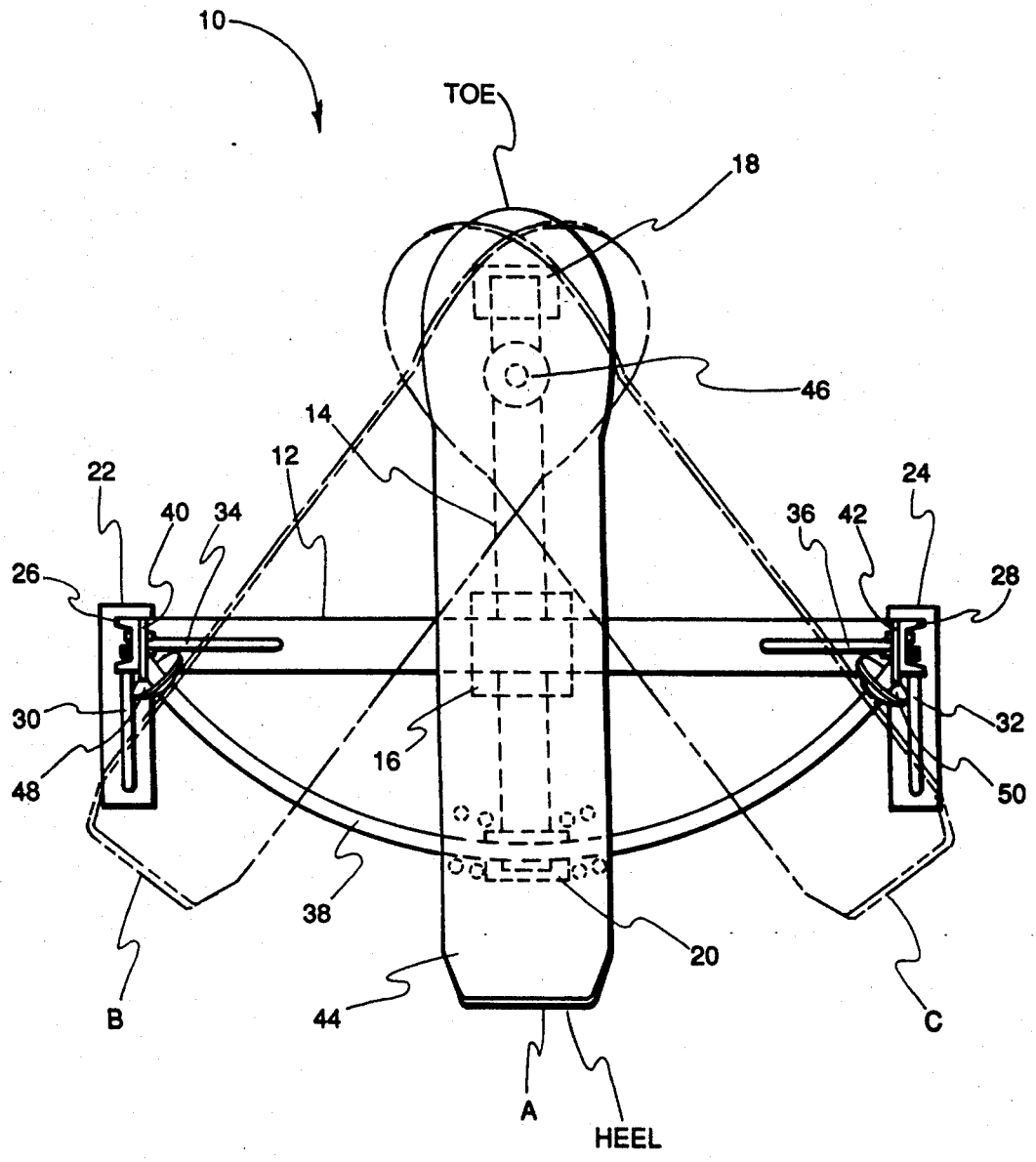
FIG. 1 is a top plan view of the training device according to the present invention.
Figure 2:
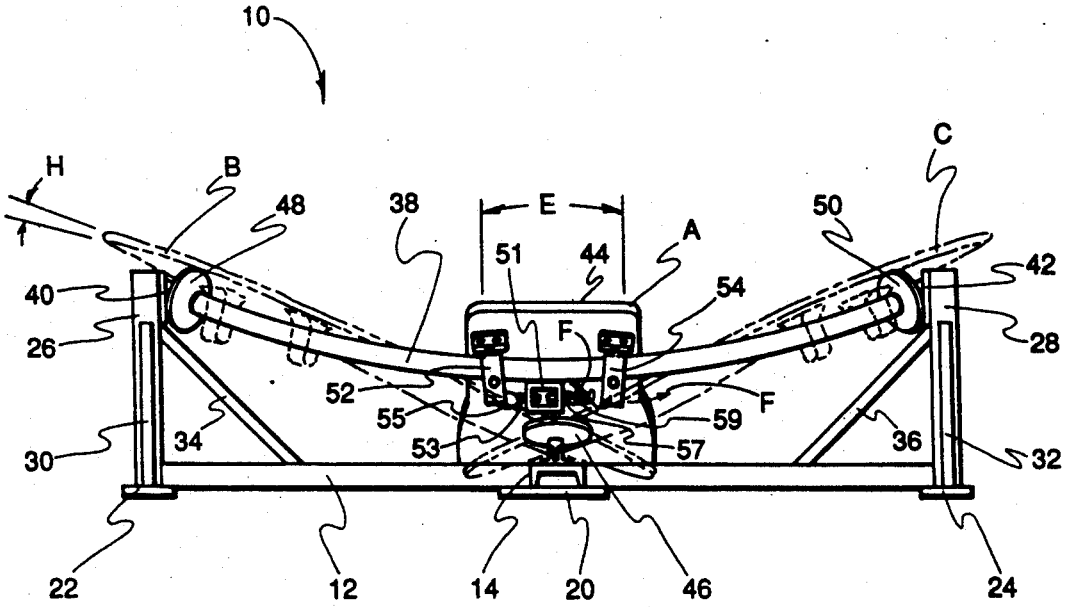
FIG. 2 is a rear elevational view illustrating the training device.
Figure 3:
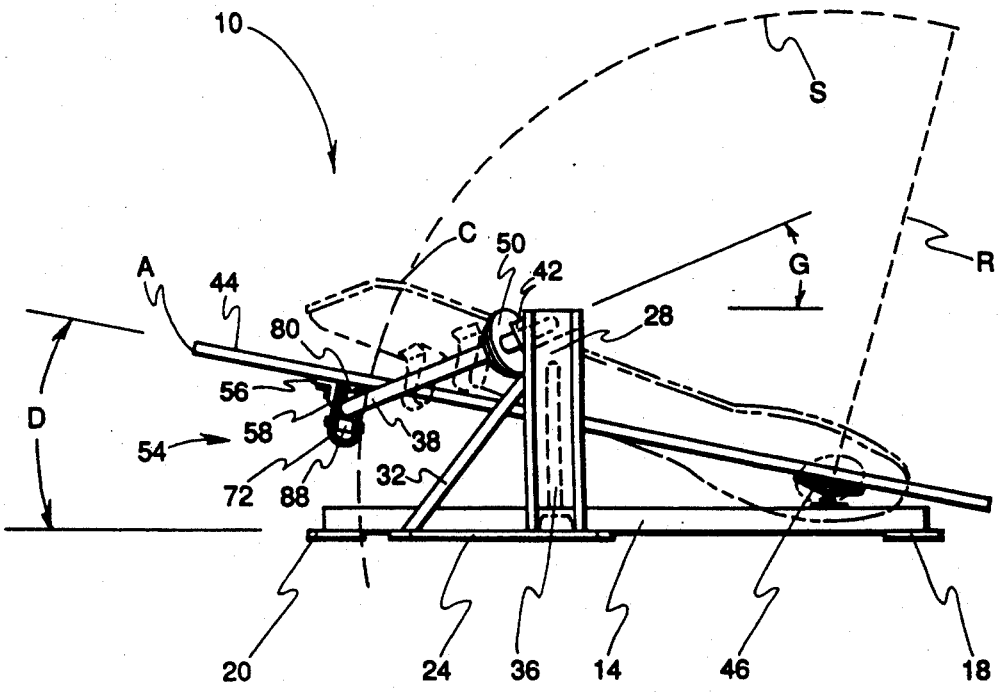
FIG. 3 is a right side elevational view illustrating the training device.

Referring now to the drawings, wherein like reference numerals designate corresponding structure throughout the views, and referring in particular to FIGS. 1–3, an improved training device 10 according to a preferred embodiment of the invention includes a horizontal base formed by perpendicularly intersecting rail members 12 and 14. Support plates 16, 18, 20, 22 and 24 secured to the rail members lie in a common horizontal plane for abutment with a floor, deck or ground surface. A pair of vertical posts 26 and 28 extend upwardly from the support plates 22 and 24, respectively. A plurality of diagonal brace struts 30, 32, 34 and 36 increase the strength and stability of the posts 26 and 28.

Figure 5:
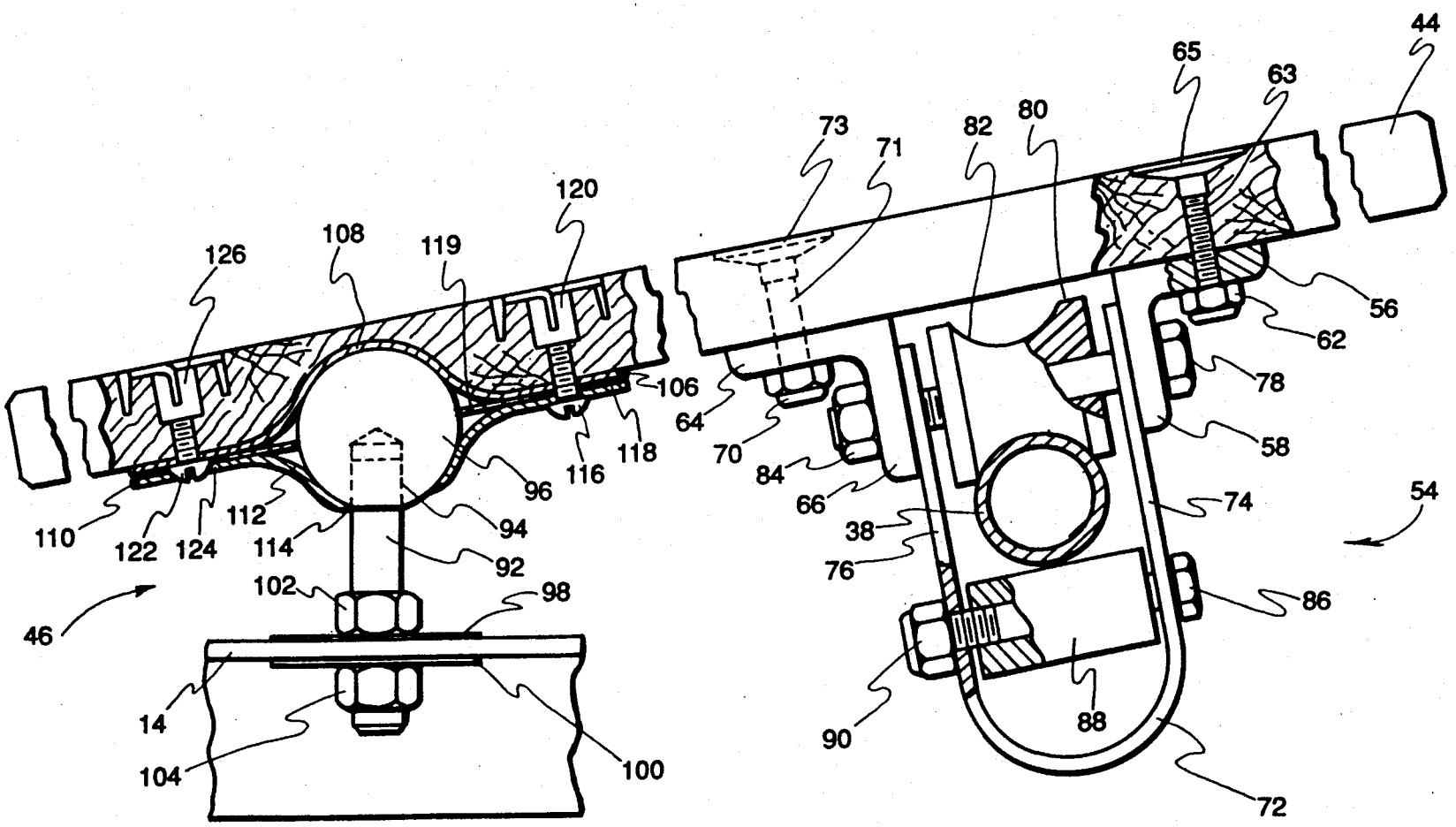
FIG. 5 is a detail view, partially cut away and in cross-section, illustrating the pivotal mounting of the support member and the guide roller assembly of the training device.

An arcuate tubular track 38 terminates at opposite ends in mounting plates 40 and 42 secured to posts 26 and 28, respectively. The track 38 has a substantially circular transverse cross-sectional shape, as shown in FIG. 5, and has a circular curvature which may be formed by bending of a metal tube. The track 38 forms a segment of a circle lying in a plane inclined at an angle G in the range of about ten to thirty degrees with respect to a horizontal plane, as shown in FIG. 3. The track 38 may have a radius of curvature of about twenty-five inches.

An elongated support member 44, configured in the shape of a snow board, has a rounded first, or "toe", end and a straight second., or "heel", end. The support member 44 is preferably about four feet long and about one foot wide. As illustrated in FIG. 3, the support member 44 lies in a plane inclined at an angle D of about ten degrees with respect to a horizontal plane, when the support member 44 is disposed at the center of the track 38, such that the toe end of the support member 44 is disposed below the heel end, to simulate movement of a snow board down a slope.

A pivot mounting mechanism 46 secured to the bottom surface of the support member 44, adjacent the toe end, serves to pivotally mount the support member 44 on the rail 14. As shown in FIG. 5, the pivot mechanism 46 includes a steel ball 96 received in a complimentary socket 108. The curvature of the track 38 is such that the circular segment formed by the track 38 lies on the surface of an imaginary sphere S having a center at the center of the ball 96, as shown in FIG. 3. Note that this does not require that the track 38 and the imaginary sphere S have equal radii. Rather, the radius of curvature track 38 may be selected within a wide range, and may be equal to or smaller than the radius R of the imaginary sphere S, as long as the angle of inclination G is selected such that the circular segment formed by the track 38 will lie upon the surface of the imaginary sphere S, in a manner somewhat analogous to the disposition of non-equatorial latitude lines on the surface of a spherical globe. Additionally, the track 38 may be formed with a non-circular or irregular curvature, while still lying on the surface of the imaginary sphere S. Such a curved track may be visualized by thinking of drawing a non-circular or irregularly curved continuous line segment on the surface of a sphere.

A stud 92 has one end secured, by silver brazing for example, within a bore 94 formed radially in the ball 96. An opposite, threaded end of the stud 92 is secured to the frame rail 14 via washers 98, 100 and nuts 102, 104. The vertical position of the ball 96 above the rail 14 may thus be adjusted to compensate for manufacturing tolerances, so as to ensure the proper relationship between the track 38 and the ball 96. The socket 108 is formed by generally hemispherical juxtaposed recesses in circular plates 106 and 110, which may be formed from sheet metal through a stamping process. A circular aperture 114 formed centrally through the wall of the hemispherical recess 112 in the plate 110 receives the stud 92 and affords sufficient clearance to allow the desired range of pivotal movement of the support member 44. The plate 106 is secured to the bottom surface of the support member 44, adjacent the toe end, by a plurality of screws arranged on a common bolt circle, one of which is shown at 122. An enlarged clearance hole 124 formed through the plate 110, in axial alignment with each of the screws 122, facilitates installation and removal. A second plurality of screws, one of which is shown at 116, are arranged on the same bolt circle as the screws 122 and are interposed therebetween. Screws 116 extend through equal diameter holes in each of the plates 106 and 110. A plurality of washers 118, disposed around each of the screws 116, maintain a slight spacing between the plates 106 and 110, such that the ball 96 will not be clamped against movement. A circular felt washer 119, sandwiched between the plates 106, 110 and treated with a lubricant, such as oil, has a central circular aperture receiving the ball 96. The washer 119 functions as a lubricating wiper for the ball 96, and also as a seal to prevent dirt from entering between the plates 106 and 110. Cooperating nut members 120 and 126, for the screws 116 and 110 respectively, are driven into and flush with the top surface of the support member 44.

Figure 4:
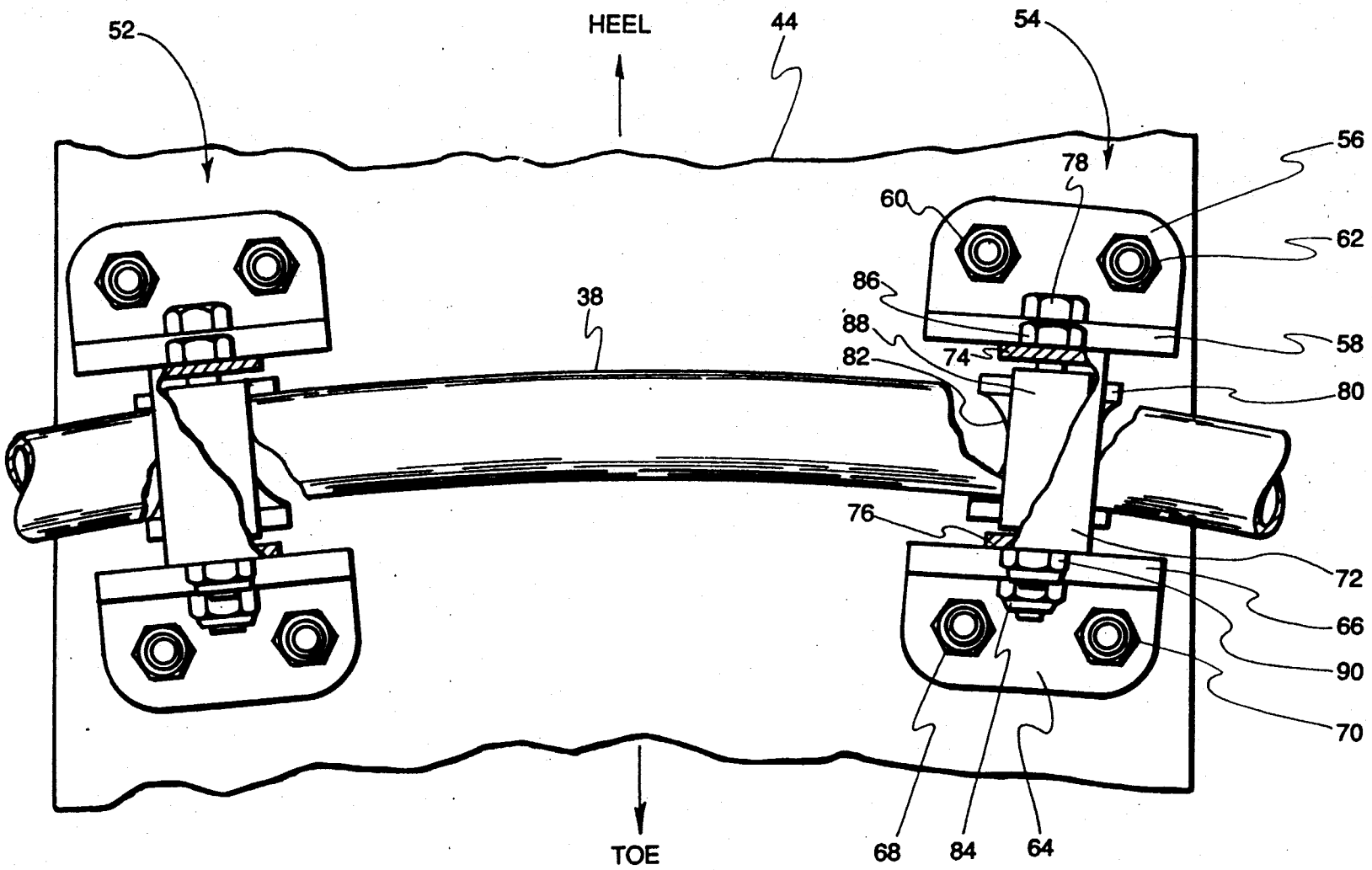
FIG. 4 is a detail view, partially cut away and in cross-section, illustrating the guide roller assembly mounting the support member for movement along the arcuate track of the training device.

A guide roller assembly disposed on the bottom surface of the support member 44, adjacent the heel end, mounts the support member 44 for movement along the track 38. As shown in FIG. 4, the guide roller assembly includes two symmetrically formed pairs of guide rollers 52 and 54, preferably spaced about eight inches apart. As such, a complete understanding of the guide roller assembly can be achieved through reference to the following detailed description of the guide roller pair 54, with reference to FIGS. 2–5. A first right angle bracket includes a first leg 56 secured to the bottom surface of the support member 44 by threaded nuts 60 and 62 cooperating with threaded shanks 63 of elevator bolts 65. A second leg 58 extends perpendicular to the first leg 56. A second right angle bracket includes a first leg 64 secured to the bottom surface of the support member 44 by threaded nuts 68 and 70 cooperating with threaded shanks 71 of elevator bolts 73. A second perpendicular leg 66 is disposed in spaced parallel relation with the leg 58. A generally U-shaped roller bracket 72 has parallel side wall portions 74 and 76 secured respectively to legs 58 and 66 by a bolt 78 and cooperating nut 84. The bolt 78 also passes axially through and forms an axle for an upper roller 80 disposed above the track 38. The upper roller 80 is formed with a concave surface 82 dimensioned for conformance with the circular transverse cross-sectional shape of the track 38. A lower roller 88, positioned below the track 38, is received for rotation on a bolt 86 extending between the side walls 74 and 76 of the roller bracket 72, and secured by a nut 90.

The roller bracket 72 is mounted for adjustable pivotal movement with respect to the fixed bracket legs 58 and 66 about the axis of the central longitudinal axis of the bolt 78. As the bracket 72 is pivoted along the arc F shown in FIG. 2, the position of the upper roller 80 will remain constant, and the lower roller 88 will be moved towards or away from the track 38, thus adjusting the vertical separation between the rollers 80 and 88. By positioning the lower roller 88 closer to the track 38, the frictional resistance to movement of the support member 44 along the track 38 can be increased. As shown in FIG. 2, an example mechanism for pivotally adjusting the roller pairs 52 and 54 includes a turnbuckle 51 having oppositely directed, collinear threaded rods 53 and 57. The rod 53 terminates in a hook which is secured to the roller bracket 72 of the roller pair 52 by a wire loop 55. The opposite rod 57 terminates in a hook secured to one end of a coil spring 59. An opposite end of the spring 59 is secured to the bracket 72 of the roller pair 54. Accordingly, rotation of the turnbuckle about the collinear axes of the threaded rods 53 and 57 will pivot roller pairs 52 and 54 together or apart, depending upon the direction of rotation. Movement of the roller pairs 52 and 54 together will decrease roller separation and increase the resistance to movement of the support member 44 along the track 38. Conversely, movement of the roller pairs 52 and 54 apart will increase roller separation and decrease the resistance to movement of the support member 44 along the track 38. The spring 59 allows some pivotal movement of the brackets 72 of the roller pairs 52 and 54, to compensate for manufacturing tolerances in the dimensions and assembly of the various components. It should be noted that a variety of other mechanisms can be employed to adjust roller separation, without departing from the scope of the present invention. For example, aligned vertical slots could be provided in the side walls 74 and 76 of the roller bracket 72, such that the bolt 86 may be adjustably positioned along the length of the slots.

The roller pairs 52 and 54 are preferably oriented on the bottom surface of the support member 44 at an included angle E, such that the longitudinal axes of pivot bolts 78 for each of the roller pairs 52 and 54 are oriented perpendicular to a tangent of &he track 38 at a location adjacent the respective roller pair, when the support member 44 is disposed as a central position along the track 38, as shown in FIGS. 2 and 4. Thus, the axes of rotation of rollers 80 and 88 forming each roller pair are disposed in spaced, parallel relation, while axes of rotation of rollers in different pairs are obliquely inclined.

A pair of resilient disks 48 and 50 are disposed on the track 38, and serve as stop members to limit the movement of the support member 44 and prevent impact with the posts 26 and 28. The disks 48 and 50 may be formed from a material such as rubber to dampen shock and prevent damage to the apparatus. The posts 26 and 28 may also be covered with a suitable padding material to protect a user in the event of a fall.

The various components of the training device 10 may be formed from a variety of different materials, within the intended scope of the invention. Preferably, the frame components are formed from an aluminum alloy and assembled by welding or through the use of rivets or bolts, so as to afford a strong assembly that is light in weight to facilitate transportation. The track 38 is preferably formed from steel tubing, so as to provide sufficient rigidity. The rollers 80, 88 may be formed of a low friction synthetic material such as nylon or DELRIN (tm). The support member 44 may be formed from wood, fiberglass, metal, or other suitable materials.

In the manner of use of the training device 10 according to the present invention, a user stands on the upper surface of the support member 44, facing in the general direction of the toe end, although with his body facing somewhat sideways. The user places one foot forward of the other, generally above the ball and socket pivot mechanism 46, and places the other foot back toward the heel end, about eighteen inches from the forward foot. The user then swings the support member from side to side through an arc up to a maximum of about ninety degrees along the track 38 by rotating his lower body and flexing his ankles. As shown in FIGS. 1 and 2, the support member 44 moves in a compound arcuate path from a first side position B of maximum vertical elevation in which the planar top surface of the support member is inclined such that the left longitudinal side edge is disposed above the right longitudinal side edge, to a second, central position A of minimum vertical elevation where the left and right longitudinal side edges are at substantially equal vertical elevations, to a third side position C in which the planar top surface of the support member 44 is inclined such that the right longitudinal side edge is disposed above the left longitudinal side edge. This movement simulates the proper edging technique employed when turning an actual snow board on a slope. For example, when making a turn to the left on snow, a snow board must be on its left edge, which becomes the uphill edge as the turn progresses. Similarly, when turning to the right, the snow board must be on its right edge.

As the user swings the support member 44 from side to side, he or she must allow the support member 44 to follow the curvature of the track 38. The curvature of the track 38 controls the proper edging or lateral inclination of the support member 44 for the degree of swing from side to side. Thus, as the support member 44 swings away form the central position A on the track 38 toward either side position B or C, the lateral inclination or degree of edging of the support member is progressivley increased, in proportion to the angular displacement or degree of swing from the central position A, up to a maximum angle of lateral inclination H of about fifteen degrees, as shown in FIG. 2. When the user either resists the edging of lateral inclination of the support member 44, or attempts to increase the degree of edging or lateral inclination, an increased resistance to the side to side swinging movement is felt. This resistance is proportional to the degree of improper edging or lateral inclination of the support member 44 on the part of the user. The amount of resistance to the swing of the support member 44 along the track 38 can be adjusted, as described previously, by adjusting the spacing of the lower rollers 88 from the track 38, to provide a sort of stubbing action.

It should also be noted that training device 10 may be modified to simulate slopes of differing degrees of steepness. For example, by decreasing the angle of inclination G (FIG. 3) of the track 38, along with a corresponding change in the radius of the track 38 to maintain the circular segment formed by the track 38 on the surface of the imaginary sphere having a center at the center of the ball 96, the support member 44 will be oriented at a greater angle D, simulating a steeper slope. Additionally the degree of edging or lateral inclination of the support member 44 as it is moved along the track 38 may be increased by forming the track 38 with a smaller radius of curvature, along with a corresponding adjustment of the angle of inclination G of the track 38 to maintain the circular segment formed by the track 38 on the surface of the imaginary sphere.

In addition to serving as a teaching aid, the training device 10 can also be employed as a fitting aid in determining the proper placement of the binding on the top surface of a snow board. The support member 44 of the training device 10 is preferably not provided with bindings, so that an individual will be able to readily move his feet in the event of a fall, and thus minimize the chance of a sprained ankle or other injury. The entire top surface or selected portions of the top surface of the support member 44 may be provided with a textured, friction enhancing coating to prevent a user's feet from slipping. An individual may ascertain the desired placement of his feet through experimentation on the training device 10, and utilize this information to determine the position at which the bindings are secured on an actual snow board. Accordingly, the training device 10 may be utilized in stores where snow boards are sold or rented to consumers, to facilitate installation and adjustment of the snow board bindings.

While the training device of the present invention has been illustrated and described with respect to use as a snow board simulator, it should be noted that it may be easily adapted for use as a simulator for a mono-ski.

It is to be understood, however, that even though numerous characteristics and advantages of the present invention have been set forth in the foregoing description, together with details of the structure and function of the invention, the disclosure is illustrative only, and changes may be made in detail, especially in matters of materials, shape, size and arrangement of parts within the principles of the invention to the full extent indicated by the broad general meaning of the terms in which the appended claims are expressed.

I claim:

1. A training device, comprising:

a frame;

an arcuate track secured to said frame, said track having opposite ends disposed at a vertical elevation above an intermediate portion of said track;

at least one support member;

a ball and socket mounting said support member for pivotal movement;

said track lying on a surface of an imaginary sphere having a center at the center of said ball;

said track forming a segment of a circle lying in a plane obliquely inclined to a horizontal plane, said segment being orientated downwardly and outwardly away from said ball such that said track disposes said support member in an orientation obliquely declined to said horizontal plane downwardly and inwardly toward said ball; and guide means mounting sad support member for movement along said arcuate track.

2. The training device of claim 1, wherein said support member has first and second opposite ends, with said ball and socket disposed adjacent said first end and said guide means disposed adjacent said second end.

3. The training device of claim 1, wherein said guide means includes at least one roller.

4. The training device of claim 1, wherein said arcuate track possesses a substantially circular transverse cross-sectional shape.

5. The training device of claim 1, wherein said arcuate track is inclined at an angle in the range of about ten to thirty degrees with respect to said horizontal plane.

6. The training device of claim 1, wherein said guide means comprises at least one pair of rollers disposed on opposite sides of said arcuate track.

7. The training device of claim 6, further comprising means for adjusting the relative orientation of said rollers.

8. The training device of claim 7, wherein said means for adjusting the relative orientation of said rollers includes means mounting at least one of said rollers for pivotal movement toward and away from said arcuate track,

9. The training device of claim 8, wherein a roller disposed beneath said arcuate track is mounted for pivotal movement.

10. The training device of claim 6, wherein at least one to said rollers has a concave surface conforming to said arcuate track.

11. The training device of claim 6, further comprising means securing said pair of rollers to said support member.

12. The training device of claim 6, further comprising means for adjusting said rollers to regulate resistance to movement of said support member along said arcuate track.

13. The training device of claim 1, further comprising stop means disposed adjacent said opposite ends of said arcuate track for limiting movement of said support member.

14. The training device of claim 13, wherein said stop means comprises a pair of resilient disks disposed on said arcuate track.

15. The training device of claim 1, wherein said ball and socket pivotally mounts said support member on said frame.

16. The training device of claim 1, wherein said support member is substantially straight and has substantially parallel and substantially planar top and bottom surfaces.

17. The training device of claim 1, wherein said support member is configured in the shape of a snow board.

18. The training device of claim wherein said frame includes a substantially horizontally disposed base and a pair of spaced, substantially vertically disposed posts, said arcuate track extending between said posts.

19. The training device of claim 18, wherein said ball and socket pivotally mounts said support member on said base.

20. The training device of claim 1, wherein said guide means includes two pair of rollers, with one roller of each pair disposed above said arcuate track, and another roller of each pair disposed below said arcuate track.

21. The training device of claim 20, wherein each of said rollers of each of said pairs of rollers are mounted in vertically spaced relation in a bracket.

22. The training device of claim 21, wherein each of said brackets are mounted for pivotal adjustment on said support member, whereby vertical orientation of the rollers in each pair may be independently adjusted.

23. The training device of claim 22, further comprising means extending between said brackets for selectively pivoting said brackets together or apart.

24. The training device of claim 23, further comprising means for allowing limited pivotal movements of said brackets against a spring bias.

25. The training device of claim 20, wherein axes of rotation of rollers forming each pair are disposed in spaced, substantially parallel relation and axes of rotation of rollers in different pairs are obliquely inclined.

26. A training device, comprising:

a frame;

a track secured to said frame, said track possessing a substantially circular transverse cross-sectional shape;

at least one elongated support member having first and second opposite ends;

pivot means disposed adjacent said fist end of said support member pivotally mounting said support member on said frame;

at least one pair of rollers disposed adjacent said second end of said support member, one of said rollers disposed above said track and another of said rollers disposed below said track; and means for adjusting vertical orientation of said rollers.

27. The training device of claim 26, wherein said track is arcuate.

28. The training device of claim 27, wherein said pivot means comprises a ball and socket, and said arcuate track lies on a surface of an imaginary sphere having a center at the center of said ball.

29. The training device of claim 27, wherein said track forms a segment of a circle.

30. The training device of claim 26, wherein said track forms a segment of a circle lying in a plane inclined to a horizontal plane at an angle in the range of about ten to thirty degrees.

31. The training device of claim 26, wherein said frame includes a substantially horizontal base and a pair of spaced, substantially vertical posts, said track extending between said posts and having opposite ends disposed at a vertical elevation above an intermediate portion of said track.

32. The training device of claim 26, wherein said rollers are mounted in substantially parallel relation in a bracket.

33. The training device of claim 32, wherein said bracket is pivotally secured to said support member.

34. The training device of claim 33, wherein said bracket is mounted for pivotal movement about an axis substantially collinear with an axis of rotation of said roller disposed above said track.

35. The training device of claim 26, wherein said roller disposed above said track has a concave surface conforming to the circular transverse cross-sectional shape of said track.

36. The training device of claim 26, wherein two pairs of rollers are disposed adjacent said second end of said support member, with one roller of each pair disposed above said track and another roller of each pair disposed below said track.

37. The training device of claim 36, wherein rollers in each pair are mounted in substantially parallel relation in a bracket.

38. The training device of claim 37, wherein each of said brackets are pivotally secured to said support member.

39. The training device of claim 38, further comprising means extending between said brackets for selectively pivoting said brackets together or apart.

40. The training device of claim 39, further comprising means for allowing limited pivotal movements of said brackets against a spring bias.

41. The training device of claim 37, wherein each of said brackets are mounted for pivotal movement about an axis of rotation substantially collinear with an axis of rotation of the respective roller disposed above said track.

42. The training device of claim 36, wherein each of said rollers disposed above said track has a concave surface conforming to the circular transverse cross-sectional shape of said track.

43. The training device of claim 36, wherein axes of rotation of rollers forming each pair are disposed in spaced, substantially parallel relation and axes of rotation of rollers in different pairs are obliquely inclined.

44. The training device of claim 26, further comprising stop means disposed adjacent opposite ends of said track for limiting movement of said support member.

45. The training device of claim 44, wherein said stop means comprises a pair of resilient disks disposed on said track.

46. The training device of claim 26, wherein said track is arcuate.

47. The training device of claim 46, wherein said track is obliquely inclined with respect to a horizontal plane.

48. The training device of claim 46, wherein said track is inclined at an angle in the range of about ten to thirty degrees with respect to a horizontal plane.

49. The training device of claim 26, wherein said track has a circular curvature.

50. The training device of claim 26, wherein said track forms a segment of a circle.

51. The training device of claim 26, wherein said track forms a segment of a circle lying in a plane obliquely inclined with respect to a horizontal plane.

52. The training device of claim 26, wherein said track forms a segment of a circle lying in a plane inclined with respect to a horizontal plane at an angle in the range of about ten to thirty degrees.

53. The training device of claim 26, wherein said first end of said support member is disposed below said second end of said support member.

54. The training device of claim 26, wherein said support member is substantially straight and has substantially parallel and substantially planar top and bottom surfaces.

55. The training device of claim 26, wherein said support member is configured in the shape of a snow board.

56. The training device of claim 26, wherein said frame includes a substantially horizontally disposed base and a pair of spaced, substantially vertically disposed posts, said track extending between said posts.

57. The training device of claim 56, wherein said pivot means pivotally mounts said support member on said base.

58. The training device of claim 26, wherein said track possesses opposite ends disposed at a vertical elevation above an intermediate portion of said track.

59. The training device of claim 26, wherein said pivot means comprises a ball and socket.

60. A training device, comprising:

a frame;

at least one elongated support member having first and second opposite ends;

a ball and socket pivot mechanism disposed adjacent said first end of said support member, pivotally mounting said support member to said frame;

an arcuate track secured to said frame, said track lying on a surface of an imaginary sphere having a center at the center of said ball, said track possessing a substantially circular transverse cross-sectional shape, said track having opposite ends disposed at a vertical elevation above an intermediate portion of said track, said track forming a segment of a circle obliquely inclined to a horizontal plane, said segment being orientated downwardly and outwardly away from said ball such that said track disposes said support member in an orientation obliquely declined to said horizontal plane downwardly and inwardly toward said ball; and guide means disposed adjacent said second end of said support member, mounting said support member for movement along said arcuate track.

61. The training device of claim 60, further comprising means for adjusting resistance to movement of said support member along said arcuate track.

62. The training device of claim 60, wherein said guide means comprises at least one pair of rollers disposed on opposite sides of said arcuate track.

63. The training device of claim 62, further comprising means for adjusting the relative orientation of said rollers.

64. The training device of claim 63, wherein said means for adjusting the relative orientation of said rollers includes means mounting at least one of said rollers for pivotal movement toward and away from said track.

65. The training device of claim 64, wherein a roller disposed beneath said track is mounted for pivotal movement.

66. The training device of claim 62, wherein at least one of said rollers has a concave surface conforming to the circular transverse cross-sectional shape of said arcuate track.

67. The training device of claim 62, further comprising means for adjusting said rollers to regulate resistance to movement of said support member along said arcuate track.

68. The training device of claim 60, further comprising stop means disposed adjacent said opposite ends of said arcuate track for limiting movement of said support member.

69. The training device of claim 68, wherein said stop means comprises a pair of resilient disks disposed on said arcuate track.

70. A training device, comprising:

a frame;

an arcuate track secured to said frame, said track having opposite ends disposed at a vertical elevation above an intermediate portion of said track;

at least one support member;

pivot means mounting said support member for pivotal movement;

at least one pair of rollers disposed on opposite sides of said track mounting said support member for movement along said arcuate track; and means for adjusting the relative orientation of said rollers.

71. The training device of claim 70, wherein said means for adjusting the relative orientation of said rollers includes means mounting at least one of said rollers for pivotal movement toward and away from said arcuate track.

72. The training device of claim 71, wherein a roller disposed beneath said arcuate track is mounted for pivotal movement.

73. A training device, comprising:

a frame;

an arcuate track secured to said frame, said track having opposite ends disposed at a vertical elevation above an intermediate portion of said track;

at least one support member;

pivot means mounting said support member for pivotal movement;

guide means including at least one pair of rollers disposed on opposite sides of said track mounting said support member for movement along said arcuate track; and means for adjusting the relative orientation of said rollers to regulate resistance to movement of said support member along said track.

74. The training device of claim 73, wherein said guide means includes two pair of rollers, with one roller of each pair disposed above said arcuate track, and another roller of each pair disposed below said arcuate track.

75. The training device of claim 74, wherein each of said rollers of each of said pairs of rollers are mounted in vertically spaced relation in a bracket.

76. The training device of claim 75, wherein each of said brackets are mounted for pivotal adjustment on said support member, whereby vertical orientation of the rollers in each pair may be independently adjusted.

77. The training device of claim 76, further comprising means extending between said brackets for selectively pivoting said brackets together or apart.

78. The training device of claim 76, further comprising means for allowing limited pivotal movements of said brackets against a spring bias.

* * * * *